US005847307A

United States Patent [19]

Kennedy et al.

[11] Patent Number: 5,847,307

[45] Date of Patent: Dec. 8, 1998

[54] MISSILE LAUNCHER APPARATUS

[75] Inventors: Robert E. Kennedy, Monterey; Gaylord S. Olmsted, Los Altos; Richard E. Ryan, Los Gatos; Joaquim Tavares, San Jose, all of Calif.

[73] Assignee: Northrop Grumman Corporation, Los Angeles, Calif.

[21] Appl. No.: 881,642

[22] Filed: Jun. 24, 1997

[51] Int. Cl.[6] ..... F41F 3/04

[52] U.S. Cl. ..... 89/1.817; 89/1.8

[58] Field of Search ..... 89/1.817, 1.816, 89/1.8, 1.809, 1.81, 1.819; 114/238, 316, 1

[56] References Cited

U.S. PATENT DOCUMENTS

| | | | |
|---|---|---|---|
| 3,120,709 | 2/1964 | Madden | 89/1.8 |
| 3,861,271 | 1/1975 | Osborn, Jr. | 89/1.817 |
| 4,173,919 | 11/1979 | Piesik | 89/1.8 |
| 4,373,420 | 2/1983 | Piesik | 89/1.817 |
| 4,553,493 | 11/1985 | Sadler et al. | 114/1 |
| 4,579,073 | 4/1986 | Sadler et al. | 114/1 |
| 4,934,241 | 6/1990 | Piesik | 89/1.817 |
| 5,191,162 | 3/1993 | Czimmek | 89/1.802 |
| 5,194,688 | 3/1993 | Piesik | 89/1.8 |

*Primary Examiner*—Charles Jordan
*Assistant Examiner*—Theresa M. Wesson
*Attorney, Agent, or Firm*—Walter G. Sutcliff

[57] ABSTRACT

A missile launcher for use on a surface vessel includes an array of vertical sleeves each being of a size to receive a missile carrying container. The sleeves are maintained in a linear array by means of a series of frames and the lower, or breech, ends of the sleeves are collectively connected to a plenum into which water is injected during a hot launch of a missile. A selected one of the sleeves does not carry a missile but rather, functions as an exhaust or gas take up for the exhaust gases of the other missiles.

13 Claims, 7 Drawing Sheets

MISSILE LAUNCHER APPARATUS

CROSS REFERENCE TO RELATED APPLICATION

The present application is related in subject matter to Ser. No. 08/881,641, pending, filed concurrently herewith, entitled "Cooling Apparatus for a Missile Launching System", and assigned to the same assignee as the present invention.

BACKGROUND OF THE INVENTION

1. Field of the Invention

The invention in general relates to missile launchers and more particularly to a system which is particularly adapted for launch of various types of missiles from a surface ship.

2. Description of Related Art

One typical missile launch system for a surface vessel is comprised of a module of eight cells arranged in two rows of four cells each, with a relatively narrow channel, or passageway, between the two rows. Each cell is adapted to receive a missile containing canister having a ready to fire missile inside.

The cells are collectively Coupled to a plenum at their lower ends and when any missile of the module is hot launched, the hot exhaust gases are directed into the plenum and out through the narrow passageway between the rows of cells.

Although the apparatus of existing systems ensures that hot exhaust gases are directed away from the vessel when a missile is launched, the plenum must be lined with a relatively thick coating of ablative material to withstand the launch temperatures. This coating periodically must be replaced or changed for different types of missiles and therefore the equipment requires a great deal of maintenance.

Further, it would be desireable to reduce the relatively high infrared (IR) signature associated with the launch event.

The present invention provides for an improved launcher with low IR signature and low maintenance and one which can accept both hot as well as cold launch missiles.

SUMMARY OF THE INVENTION

Launcher apparatus in accordance with the present invention includes an array of vertically oriented sleeves, each having a muzzle end and a breech end with means for maintaining the sleeves fixed in the array. A plenum structure is collectively connected to the breech ends of all of the sleeves.

The sleeves are of a size to accommodate a missile carrying container, from which a missile can be launched, with the launch producing exhaust gases directed into the plenum. A selected one of the sleeves is adapted to conduct the exhaust gases from within the plenum out through the muzzle end of the selected sleeve. The selected sleeve may preferable be provided with an insert or liner which is removable such that the selected sleeve may also be used to accommodate a missile carrying container.

In order to reduce the temperatures resulting from a launch, means are provided for cooling the plenum during the launch.

DESCRIPTION OF THE PREFERRED EMBODIMENT

Figure 1:
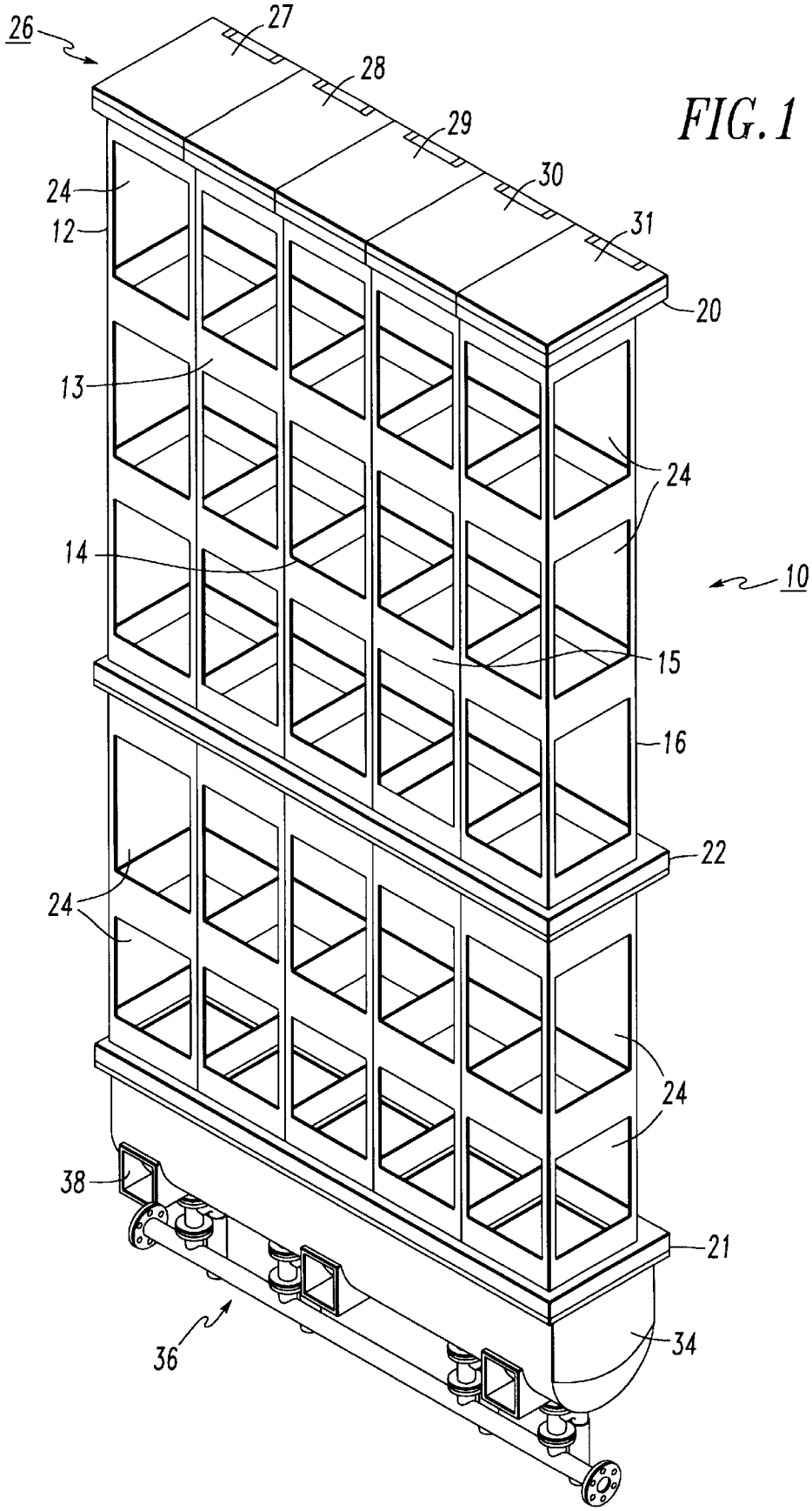
FIG. 1 is an isometric view of one embodiment of the present invention.

In the drawings, which are not necessarily to scale, like or corresponding parts are denoted by like or corresponding reference numerals.

The apparatus of FIG. 1 includes an array 10 of individual sleeves, five of which, 12 to 16, are illustrated by way of example. The upper end of each sleeve is defined as the muzzle end and the lower end is defined as the breech end. The sleeves 12 to 16 are maintained in a linear array by means of a muzzle frame 20, a breech frame 21, and an intermediate frame 22.

The overall weight of the apparatus may be reduced and access to the interior of the sleeves 12 to 16 may be obtained by providing the side walls of the sleeves with a plurality of cutouts 24.

In order to provide ballistic and environmental protection for the muzzle ends of the sleeves 12 to 16, there is provided a hard hatch assembly 26 which includes a plurality of individually operable hatch doors 27 to 31 respectively covering the muzzle ends of sleeves 12 to 16. The opposite, or breech ends of the sleeves 12 to 16 are collectively connected to a common plenum 34 having a water supply system 36, to be subsequently described. The outside of the plenum 34 includes a series of cleats 38 for fastening the structure to a foundation.

Figure 2:
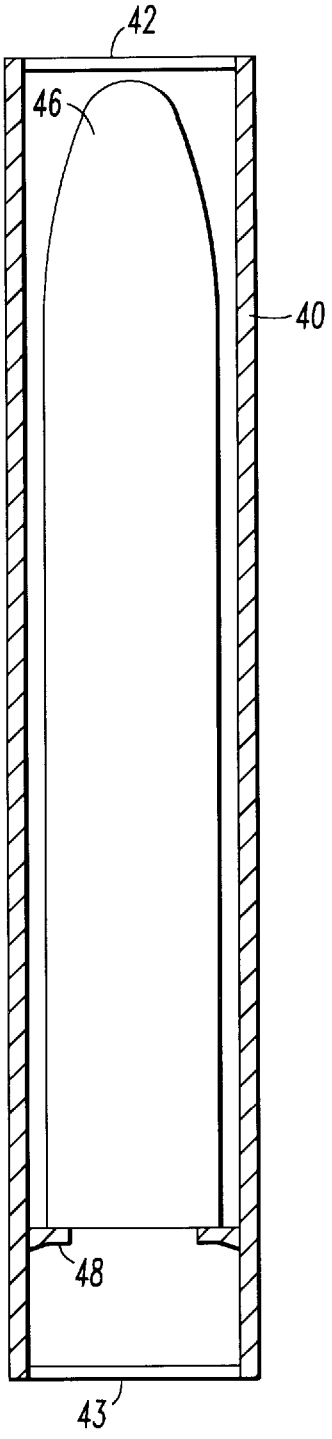
FIG. 2 is a cross sectional rudimentary view of a missile within a carrying container.

The sleeves 12 to 16 are of a particular size to accommodate a missile carrying canister such as illustrated in FIG. 2. The canister 40, which may be of corrugated construction, includes, at the upper end thereof, a frangible muzzle seal 42, and at the lower end thereof, a frangible breech seal 43. The interior of the canister 40 contains a missile 46 positioned on support 48 and in condition to be launched. Such structure is commonly known as an all up round (AUR).

Figure 3:
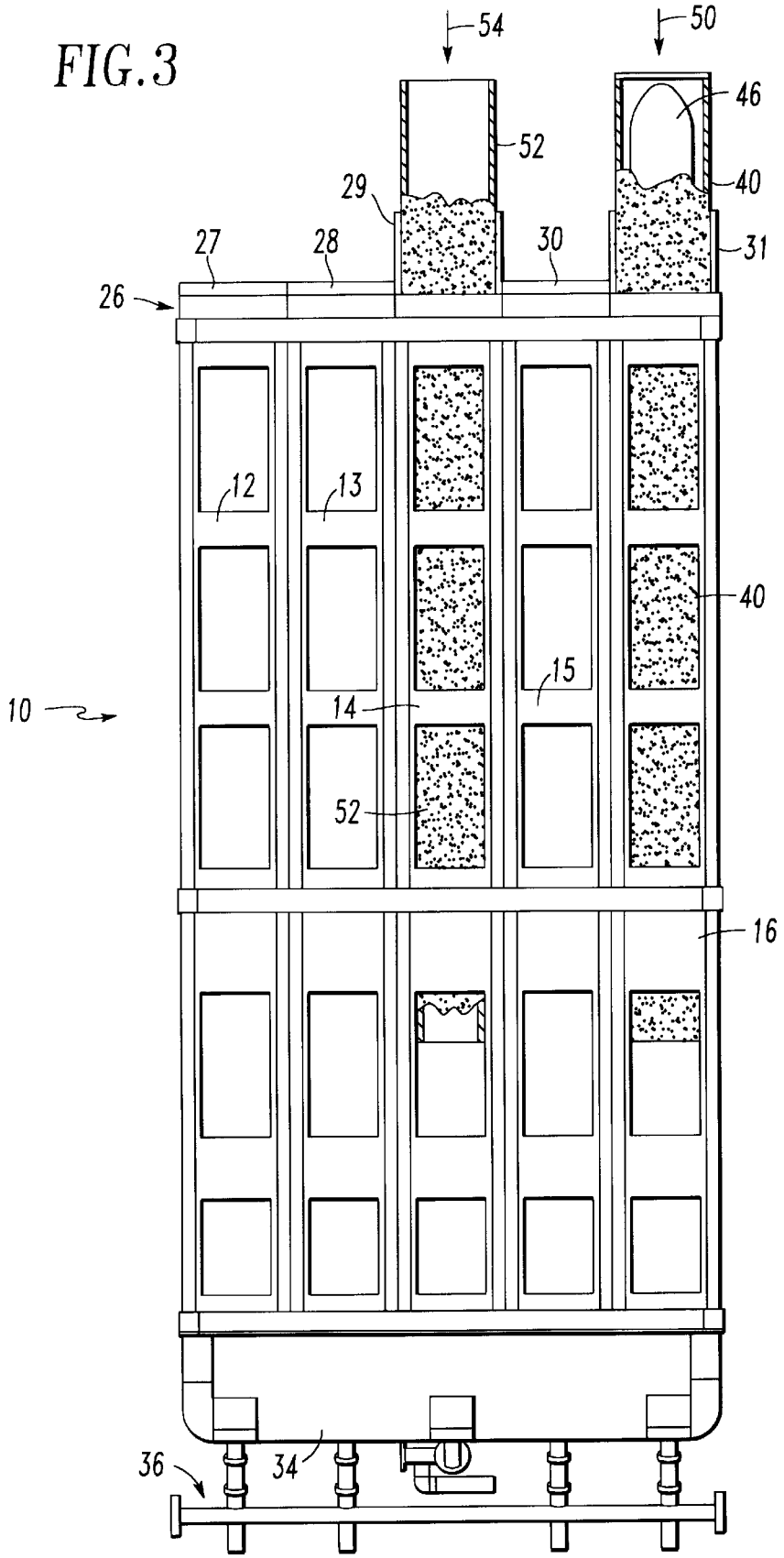
FIG. 3 is a view of the array of FIG. 1 illustrating the insertion of a missile carrying container and a gas uptake liner.

As illustrated in FIG. 3, the missile containing canister 40 is being lowered into one of the sleeves, sleeve 16, through open hatch door 31, as indicated by the arrow 50. For ease of viewing, the surface of the canister 40 has been stippled. Missile 46 is of the type that is hot launched and which produces hot exhaust gases directed into the adjacent plenum 34 during the launch.

In order to remove the hot detrimental exhaust gases from the apparatus, one of the sleeves is utilized to provide an exhaust path to the atmosphere. In FIG. 3, sleeve 14 is selected as the exhaust sleeve. If the sleeve walls have cutouts, as illustrated, sleeve 14 is provided with a removable liner or insert 52, open at both ends and shown as being inserted through hatch door 29 into sleeve 14, as indicated by arrow 54.

Figure 4:
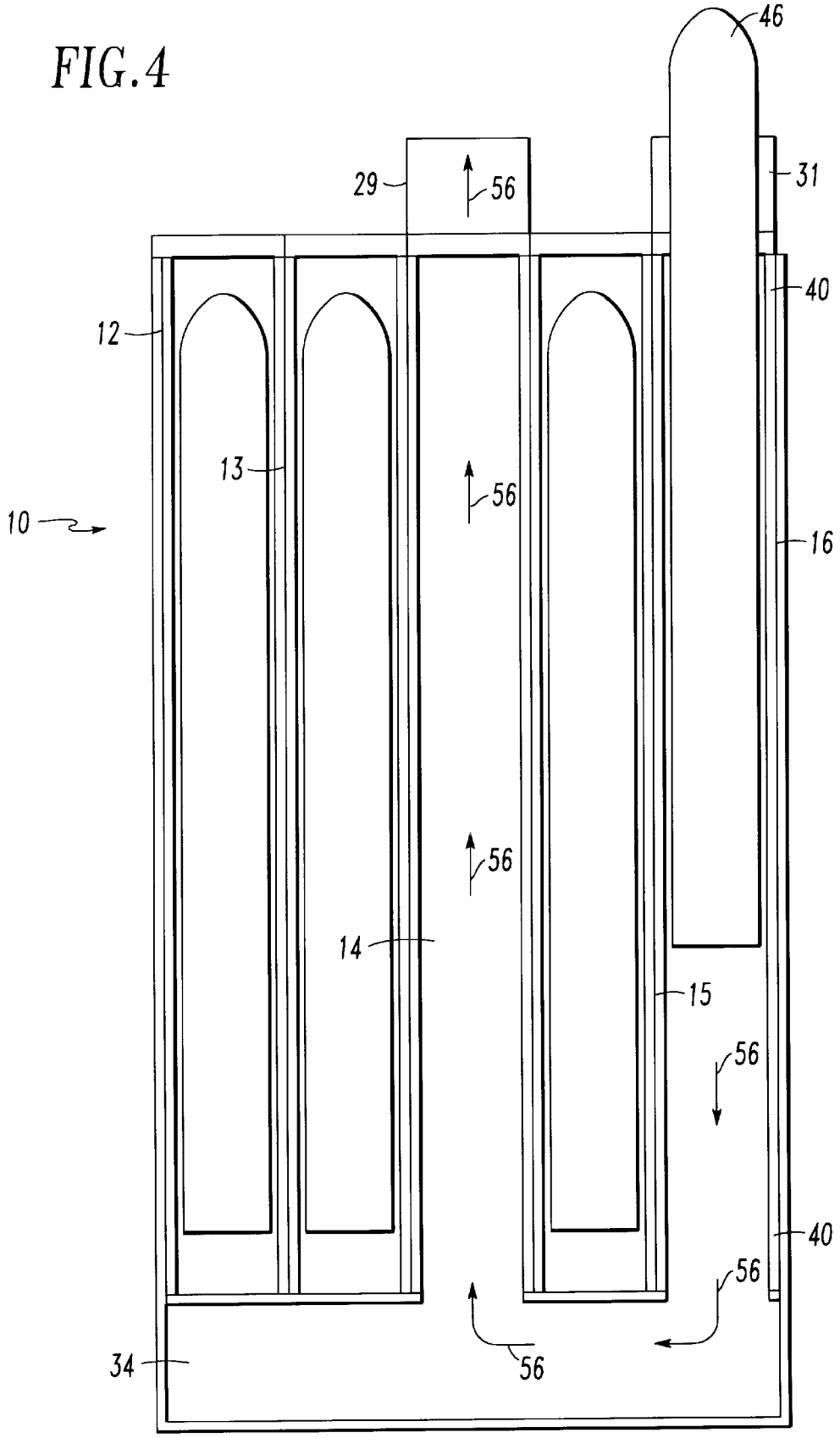
FIG. 4 illustrates gas flow during a hot launch of a missile.

FIG. 4 illustrates the array 10 wherein the sleeves 12, 13, 15 and 16 contain missiles and sleeve 14 is used as the gas uptake. A hot flyout launch by missile 46 from sleeve 16 produces hot exhaust gases which, as indicated by arrows 56, are directed into plenum 34 and up and out the middle sleeve 14. The hot launch of the other missiles will likewise produce exhaust gases which are directed out of the sleeve assembly and away from the vessel carrying the launch apparatus.

Figure 5:
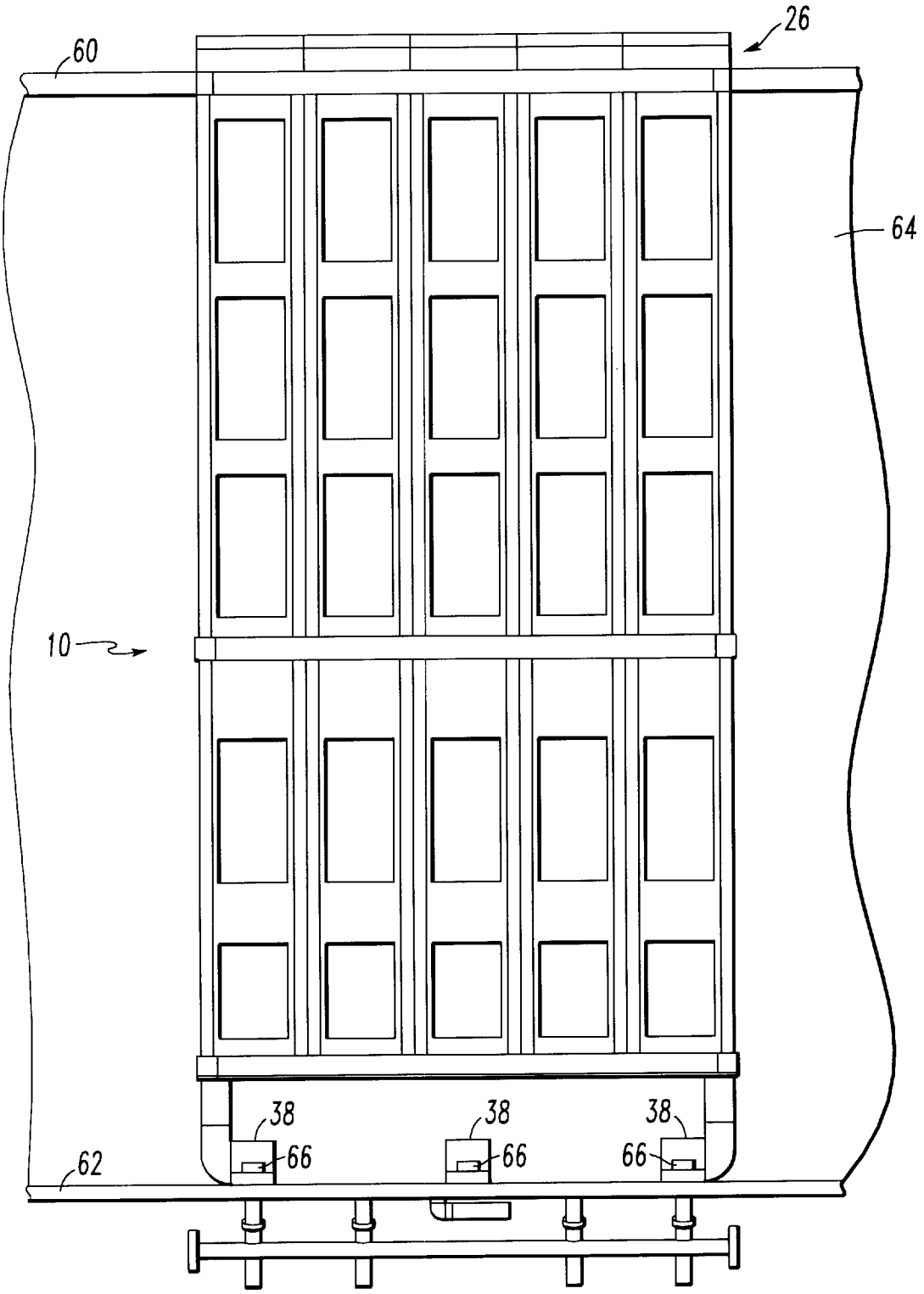
FIG. 5 illustrates the apparatus as it may be installed on a surface vessel.

FIG. 5 illustrates one type of mounting arrangement which may be utilized. The array of sleeves 10 is situated below the deck 60 of a surface vessel such that the hard hatch assembly 26 is at deck level. The plenum 34 is secured to an interior foundation 62, located in the interior 64 of the vessel, by means of cleats 38 and fasteners such as bolts 66. With this arrangement exhaust gases do not enter interior 64, but rather are directed up and away from deck 60 to the surrounding atmosphere.

The apparatus, in addition to accommodating missiles of the hot launch variety, can also accommodate submarine launch tactical missiles of the cold launch type which pop up and are ignited after ejection and when in the air. For these latter type missiles, the exhaust sleeve is not utilized and if a particular scenario just uses missiles of the cold launch variety, then all of the sleeves ,may be used to accommodate AURs.

If a hot launch is to be conducted however, then the exhaust sleeve is utilized and in addition, means must be provided to cool the plenum 34 by water injection into the exhaust plume. This water injection not only preserves the structural integrity of the plenum 34 and eliminates the need for ablative materials, but also prevents secondary combustion at the uptake exit and reduces the IR signature at the launcher apparatus.

Figure 6:
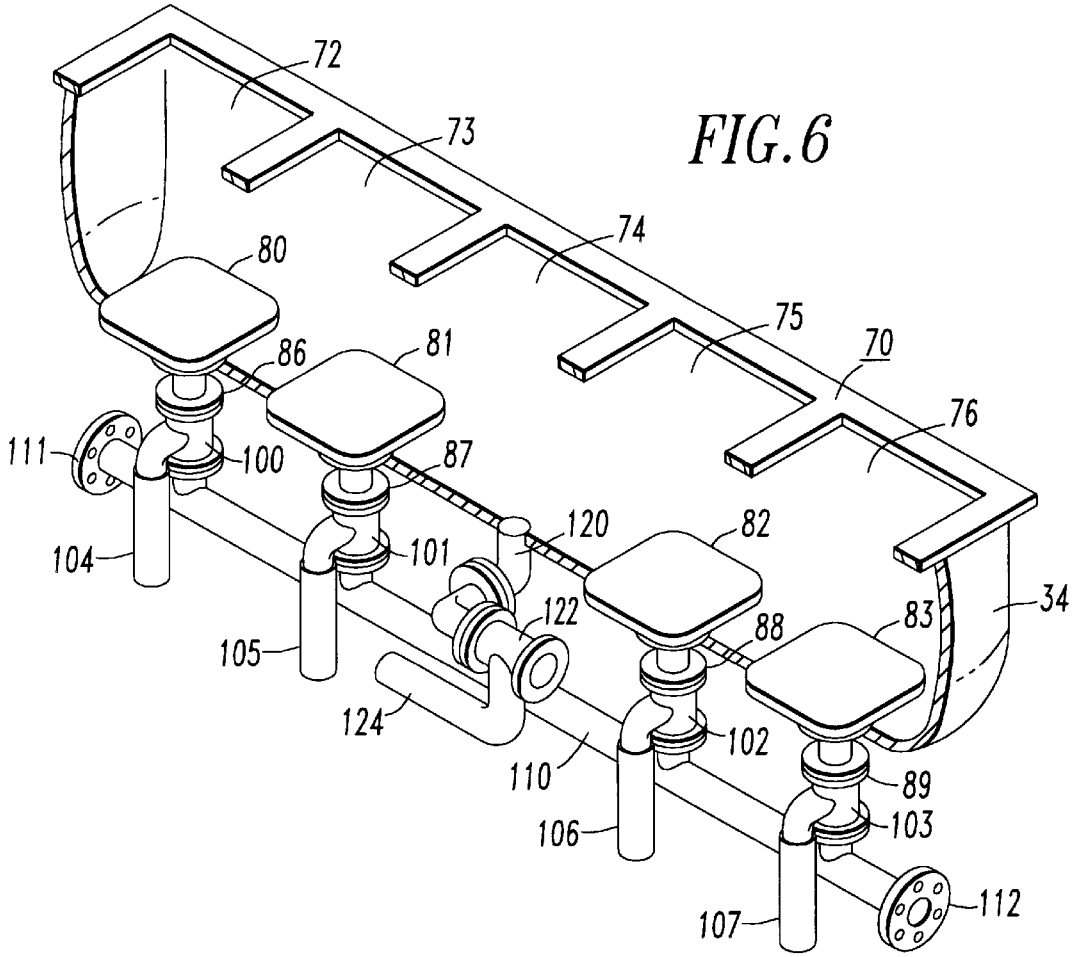
FIG. 6 is a cut away view of the plenum illustrated in FIG. 1.
Figure 7:
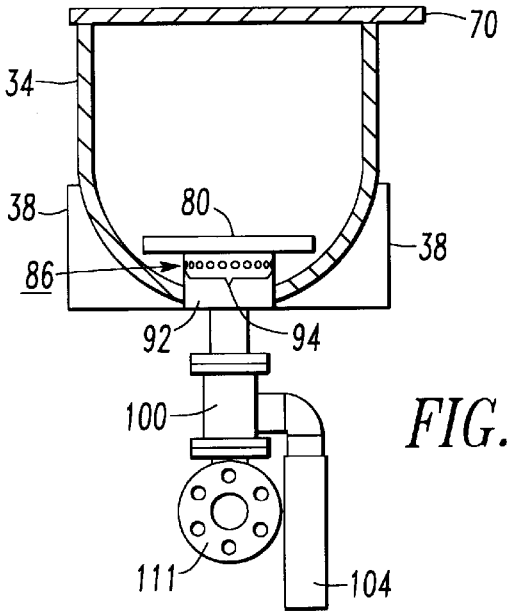
FIG. 7 is an end view of the plenum.

One type of water injection system is illustrated in FIGS. 6 and 7. In the cut away view of FIG. 6 the plenum is seen to include a top flange 70 having openings 72 to 76 adjacent to the breech ends of respective sleeves 12 to 16 (FIG. 1). Disposed within the plenum 34 is a series of impingement plates 80 to 83 against which an exhaust plume impinges from missiles in respective sleeves 12, 13, 15 and 16. No impingement plate is required for sleeve 14 which functions as the exhaust sleeve.

Connected to the underside of each of the impingement plates 80 to 83 is a respective water injection nozzle 86 to 89. A typical water injection nozzle is best seen in the end view of FIG. 7 which shows the arrangement under first sleeve 12. The water injection nozzle 86, which is typical of the other water injection nozzles, includes a metal hollow cylinder 92 having around the upper periphery thereof a series of apertures 94 through which water under pressure is injected into the plenum.

Water may be selectively supplied to the water injection nozzles 86 to 89 by means of respective valves 100 to 103, the opening and closing of which is controlled by respective valve actuators 104 to 107. The water is supplied from a source into a manifold pipe 110 having end flanges 111 and 112. One of these flanges 111 or 112 may be connected to an input water source while the other may be capped off or connected to a subsequent missile launcher array.

Injected water accumulated in the plenum may be removed through a drain 120 in fluid communication with a drain valve 122, the opening and closing of which is governed by valve actuator 124.

Figure 8:
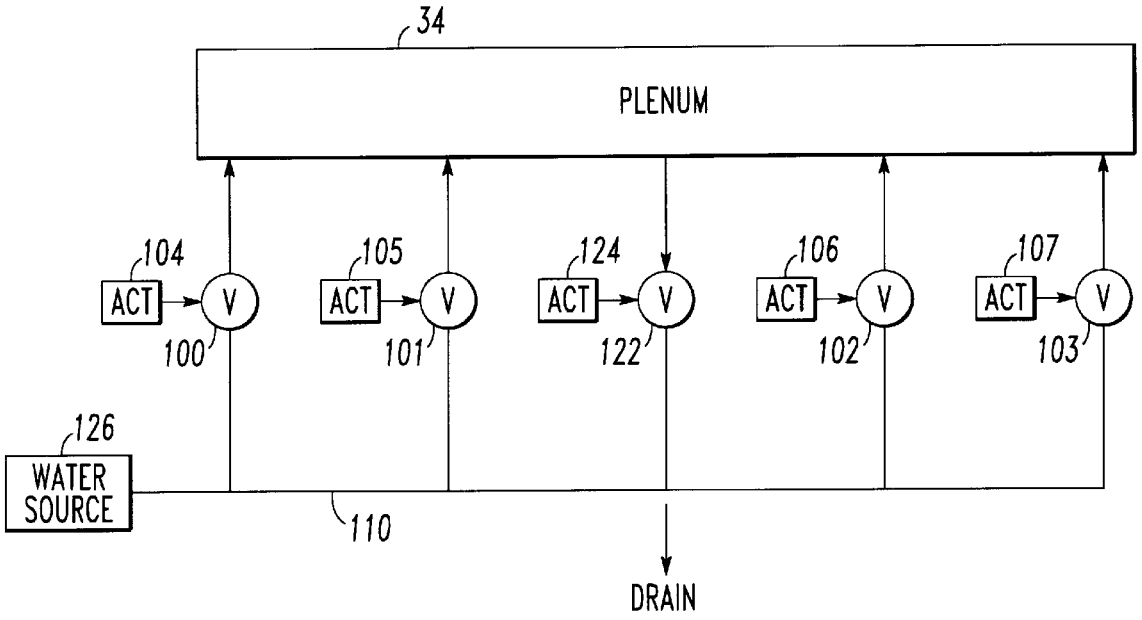
FIG. 8 is a block diagram of a water injection system.

A block diagram of the water supply and drainage arrangement is illustrated in FIG. 8. A source of water 126 is connected to the manifold pipe 110 and is supplied under pressure just prior to a hot launch. Upon opening of the appropriate valve, water is sprayed into the plenum at a predetermined rate for a period of time determined by a missile away signal. At some time during or after the launch, the drain valve may be opened to remove any accumulated water in the plenum 34.

Although the present invention has been described with a certain degree of particularity, it is to be understood that various substitutions and modifications may be made without departing from the spirit and scope of the invention as defined in the appended claims.

What is claimed is:

1. Missile launcher apparatus, comprising:

(A) an array of sleeves each having a muzzle end and a breech end;

(B) means for maintaining said sleeves fixed in said array;

(C) a plenum collectively connected to the breech ends of said sleeves in said array;

(D) said sleeves being of a size to accommodate a missile carrying container, from which a missile can be launched, said launching producing exhaust gases directed into said plenum;

(E) a selected one of said sleeves being adapted to conduct said exhaust gases within said plenum out through the muzzle end of said selected sleeve; and (F) means for cooling said plenum during a launch of said missile.

2. Apparatus according to claim 1 wherein:

(A) said means for maintaining includes a plurality of frames, each surrounding said sleeves of said array.

3. Apparatus according to claim 2 wherein:

(A) one of said plurality of frames is located at said muzzle ends of said sleeves.

4. Apparatus according to claim 3 wherein:

(A) another one of said plurality of frames is located at said breech ends of said sleeves.

5. Apparatus according to claim 1 which includes:

(A) an insert positioned within said selected sleeve.

6. Apparatus according to claim 5 wherein:

(A) said insert is removable.

7. Apparatus according to claim 1 wherein:

(A) said sleeves have side walls; and (B) said side walls include a plurality of cutouts, thereby reducing the weight of said sleeve and allowing access to the interior thereof.

8. Apparatus according to claim 1 wherein:

(A) said array is a linear array.

9. Apparatus according to claim 1 which includes:

(A) a respective hatch door positioned at the muzzle end of each said sleeve.

10. Apparatus according to claim 9 which includes:

(A) a hatch door assembly unit containing all of the hatch doors for said sleeves.

11. Apparatus according to claim 1 wherein:

(A) said means for cooling is a water injection system.

12. Apparatus according to claim 10 wherein:

(A) said array is installed on a surface vessel having a deck and a foundation below said deck in the interior of said vessel;

(B) said hatch door assembly unit is adjacent said deck; and (C) said plenum is adjacent said foundation.

13. Apparatus according to claim 12 wherein:

(A) said plenum includes a plurality of cleats; and (B) said cleats are secured to said foundation.

* * * * *